US007231962B2

(12) United States Patent
Han

(10) Patent No.: US 7,231,962 B2
(45) Date of Patent: Jun. 19, 2007

(54) HEAT EXCHANGER

(75) Inventor: Seongseok Han, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 113 days.

(21) Appl. No.: 11/254,403

(22) Filed: Oct. 20, 2005

(65) Prior Publication Data

US 2006/0090879 A1 May 4, 2006

(30) Foreign Application Priority Data

Oct. 29, 2004 (KR) ..... 10-2004-0087396

(51) Int. Cl.
*F28F 27/02* (2006.01)

(52) U.S. Cl. ..... 165/96; 165/103

(58) Field of Classification Search ..... 165/96, 165/101, 103

See application file for complete search history.

(56) References Cited

U.S. PATENT DOCUMENTS 4,432,410 A 2/1984 Cadars et al.
5,915,464 A 6/1999 Kalbacher et al.
5,968,312 A 10/1999 Sephton et al.
2005/0056402 A1 3/2005 Han et al.

FOREIGN PATENT DOCUMENTS

| | | |
|---|---|---|
| EP | 0 991 464 A | 4/2000 |
| EP | 1 515 110 A | 3/2005 |
| GB | 391 556 A | 5/1933 |
| KR | 0170234 | 3/1999 |

*Primary Examiner*—Teresa J. Walberg
(74) *Attorney, Agent, or Firm*—Fulbright & Jaworski L.L.P.

(57) ABSTRACT

The present invention relates to a heat exchanger, in which the flow of a heat exchange medium flowing through tubes is selectively controlled, and opened and closed in order to control heat exchange capability according to cooling and heating loads. More specifically, the invention relates to a heat exchanger, in which one distribution hole is constructed for one tube, so that temperature can be minutely controlled with small temperature deviation in each step, and the opening and closing method of the distribution hole is configured in a sliding type that uses a slide valve, so that the shapes of a header and a tank are simplified, and a clamping operation is also improved.

22 Claims, 12 Drawing Sheets

HEAT EXCHANGER

BACKGROUND OF THE INVENTION

This application claims priority from Korean Patent Application No. 2004-87396 filed Oct. 29, 2004, incorporated herewith by reference in its entirety.

1. Field of the Invention

The present invention relates to a heat exchanger, in which the flow of a heat exchange medium flowing through tubes is selectively controlled, and opened and closed in order to control heat exchange capability according to cooling and heating loads. More specifically, the invention relates to a heat exchanger, in which one distribution hole is constructed for one tube, so that temperature can be minutely controlled with small temperature deviation in each step, and the opening and closing method of the distribution hole is configured in a sliding type that uses a slide valve, so that the shapes of a header and a tank are simplified, and a clamping operation is also improved.

2. Background of the Related Art

As is well known generally, an air conditioner includes a cooling system and a heating system. The cooling system is configured so as to cool the inside of a vehicle by the heat exchange of an evaporator through a circulating process of a heat exchange medium discharged by the drive of the compressor, the heat exchange medium flowing into the compressor again by way of a condenser, a receiver drier, an expansion valve, and an evaporator. The heating system is configured so as to flow a heat exchange medium (engine coolant) into a heater core in order to exchange heat, and warm the inside of a vehicle.

The condenser, the evaporator, and the heater core that exchange the heat of a heat exchange medium are heat exchangers. Such heat exchangers are supplied with a heat exchange medium, exchange heat to an appropriate temperature, and circulate the medium.

As shown in FIG. 1, the conventional heat exchanger described above includes a plurality of tubes 5 arranged spaced apart from one another at a regular intervals in such a fashion that both ends of each tube are fixed to upper and lower headers 1 and 3, respectively, upper and lower tanks 7 and 9 coupled to the upper and lower headers 1 and 3, respectively, for defining passageways fluid-communicated with the apertures of the end portions of each tube 5 together with the upper and lower headers 1 and 3, and heat radiating fins 11 installed between two adjacent tubes 5 for widening a heat radiating surface area of the heat exchanger.

In the conventional heat exchanger configured as described above, at a state where the heat exchanger is mounted on an air conditioner, specifically an air conditioner for a vehicle, the heat exchange medium, which is supplied to the passageway defined by the upper tank 7 and the upper header 1, performs heat exchange while passing through the tubes 5 at one side partitioned by a baffle, makes a U-turn at a passageway defined by the lower tank 9 and the lower header 3, performs again heat exchange while passing through the tubes 5 at the other side at this point, and is discharged through the passageway defined by the upper tank 7 and the upper header 1.

In the conventional heat exchanger in which heat exchange is performed as described above, a heat exchange medium (the coolant of a vehicle) is supplied regardless of heating or cooling loads, so that a separate control means is needed in order to arbitrarily control heat exchange capability according to heating or cooling loads. For example, in the case of a heat exchanger used as a heater core of a vehicle, in order to control the heat exchange capability of the heat exchanger, a method has been used for controlling the volume of air passing through the heat exchanger by controlling the rotating speed of a blower or installing a door at the front side of the heat exchanger. An additional device is required in order to control the heat exchange capability of the heat exchanger by controlling the air volume as described above, so that the control is not reliably performed.

In order to address and solve the above problem, as shown in FIGS. 2 and 3, the inventor proposed an apparatus including a plurality of tubes 5 arranged spaced apart from one another at regular intervals in such a fashion both ends of each tube are fixed to upper and lower headers 1 and 3, respectively, a division and supply means 13 connected to the upper header 1 for supplying a heat exchange medium to a specific tube 5, and a lower tank 9 connected to the lower header 3 for defining a passageway fluid-communicated with an aperture of the end portion of each tube 5 together with the lower header 3. (refer to Korean Patent Reg. No. 170234)

The division and supply means 13 includes a plurality of connection passageways 15 defined therein so as to be fluid-communicated with an aperture of the upper end portion of each tube that is coupled to the upper header 1, a main body 17 having a cylindrical heat exchange medium divider 19, in which the inlet side of the connection passageway 15 is formed within a certain angle range, at least one heat exchange medium supplying pipe 21 installed so as to be fluid-communicated with the cylindrical heat exchange medium divider 19 formed at the main body 17, a rotating member 23 rotatably installed at the cylindrical heat exchange medium divider 19, the rotating member having a rotation axis 25 and a blocking collar 27 installed at the rotation axis 25 for selectively blocking the inlet of the connection passageway 15 fluid-communicated with the heat exchange medium divider 19, and a covering member 29 for supporting the rotation axis 25 and blocking the heat exchange medium divider 19.

In order to exchange heat with the heat exchange medium using the heat exchanger in the state described above, first, the heat exchange medium is supplied through the heat exchange medium supplying pipe 21, and the rotating member 23 rotatably installed at the heat exchange medium divider 19 is rotated according to the load applied to the heat exchanger. Then, the blocking collar 27 selectively opens and closes the inlet of the connection passageway 15 in response to the rotation of the rotating member 23, and thus the heat exchange medium is supplied to some tubes 5, or all the tubes 5.

In the case where the inlets of the connection passageway 15 are formed at both sides, the blocking collars 27 installed at both sides of the rotating member 23 open the end portions of each tube 5 at the same time, and thus some tubes 5 can be supplied with a heat exchange medium. The supply amount of the heat exchange medium is controlled according to the rotation of the rotating member 23, so that the heat exchange capability of the heat exchanger can be controlled arbitrarily.

As described above, the heat exchange medium can be selectively flown into each tube 5 of the heat exchanger, and thus the performance of the heat exchanger can be arbitrarily controlled, so that heating or cooling load can be easily coped with.

The heat exchanger is advantageous in that the amount of the heat exchange medium can be selectively controlled. However, the heat exchange medium guided by the blocking collar 27 of the rotating member 23 mostly flows into the tubes placed at one side, so that the mixing performance of the heat exchange medium is degraded, and, since the temperature deviation in each step is large, the temperature cannot be minutely controlled.

SUMMARY OF THE INVENTION

Therefore, the present invention has been made in view of the above problems occurring in the prior art, and it is an object of the present invention to provide a heat exchanger, in which the flow of a heat exchange medium flowing through tubes is selectively controlled, and opened and closed in order to conveniently control heat exchange capability according to cooling and heating loads, and the heat exchange medium is evenly distributed among the tubes, thereby improving heat exchange performance.

Another object of the invention is to provide a heat exchanger, in which one distribution hole is constructed for one tube, so that temperature can be minutely controlled with small temperature deviation in each step, and the opening and closing method of the distribution hole is configured in a sliding type that uses a slide valve, so that the shapes of a header and a tank are simplified, and a clamping operation is improved.

To accomplish the above object, according to one aspect of the present invention, there is provided a heat exchanger comprising: a plurality of tubes (101) arranged spaced apart from one another at regular intervals in such a fashion that both ends of each tube are fixed to upper and lower headers (140,190), respectively, for flowing a heat exchange medium therethrough; an upper tank (110) including a first tank (120) coupled to the upper header (140) and a second tank (130) (230) housed in the first tank (120), the first tank (120) having inlet and outlet pipes (121,122) formed at one side thereof, the second tank (130) having an array of distribution holes (131) (231) formed on a top thereof and a collecting hole (134) (234) formed at one side thereof; a first opening and closing means (160) (260) slidably installed inside the upper tank (110) for opening and closing the array of the distribution holes (131) (231); a control means (170) rotatably installed inside the upper tank (110) for receiving an external power to operate the first opening and closing means (160) (260); and a lower tank (191) coupled to the lower header (190), the lower tank being fluid-communicated with a lower end portion of each tube (101) and fluid-communicated with the upper tank (110) through a return pipe (195).

According to another aspect of the invention, there is provided a heat exchanger comprising: a plurality of tubes arranged spaced apart from one another at regular intervals in such a fashion that both ends of each tube are fixed to upper and lower headers, respectively, for flowing a heat exchange medium therethrough; an upper tank including a first tank coupled to the upper header and a second tank housed in the first tank, the first tank having an inlet and outlet pipes formed at one side thereof, the second tank having a plurality of distribution holes on top thereof at regular intervals, a collecting hole formed at one side thereof, and a distribution passage formed thereinside for distributing a heat exchange medium flown into the distribution holes to pecific tubes; a distribution means installed between the upper header and the upper tank for supplying the heat exchange medium distributed through the distribution passage to each of specific tubes separately; a first opening and closing means slidably installed inside the upper tank for opening and closing the distribution holes; a control means rotatably installed inside the upper tank for receiving an external power to operate the first opening and closing means; and a lower tank coupled to the lower header, the lower tank being fluid-communicated with a lower end portion of each tube and fluid-communicated with the upper tank through a return pipe.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

The preferred embodiments of the invention will be hereafter described in detail, with reference to the accompanying drawings.

Figure 1:
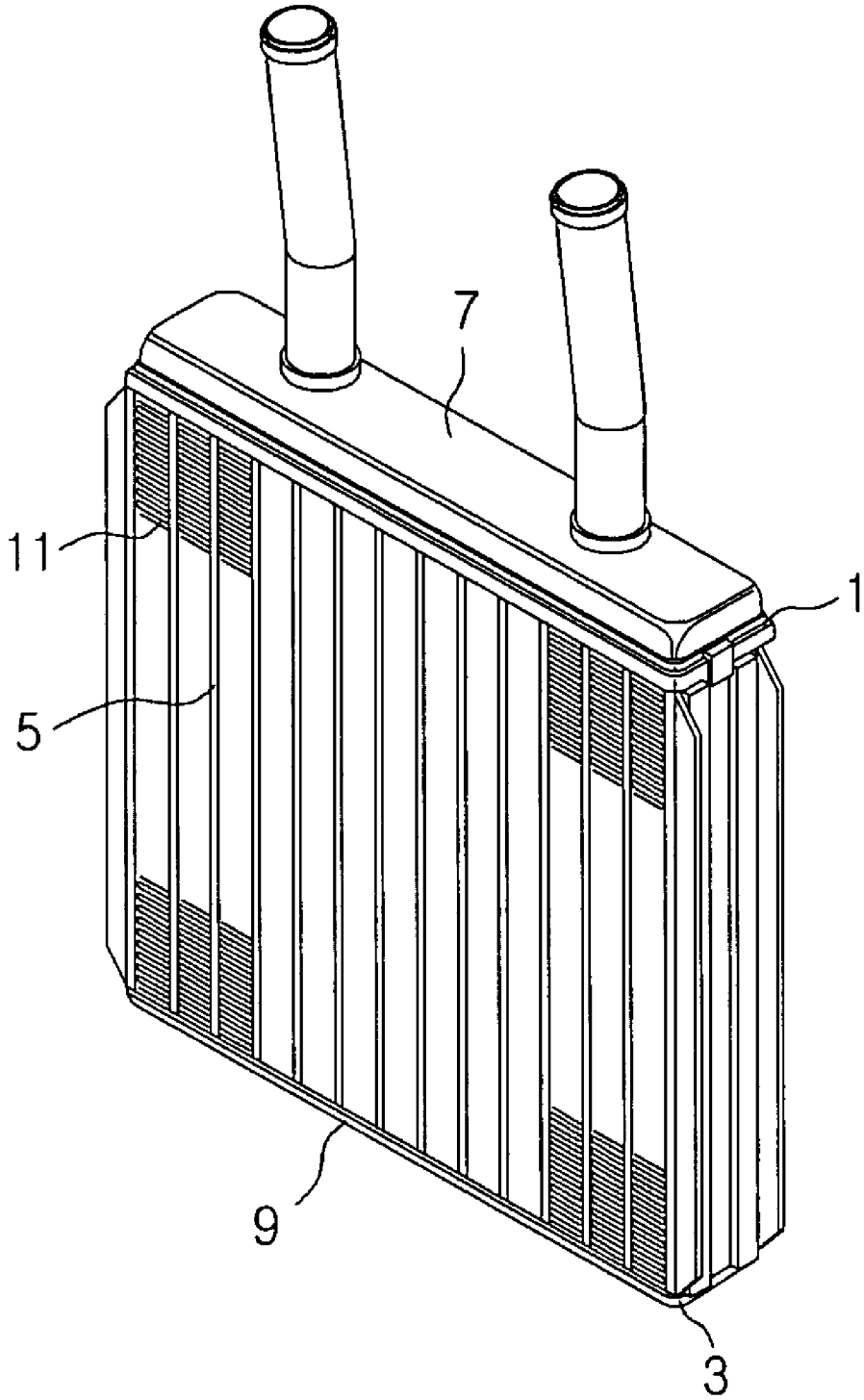
FIG. 1 is a perspective view showing a general heat exchanger.
Figure 2:
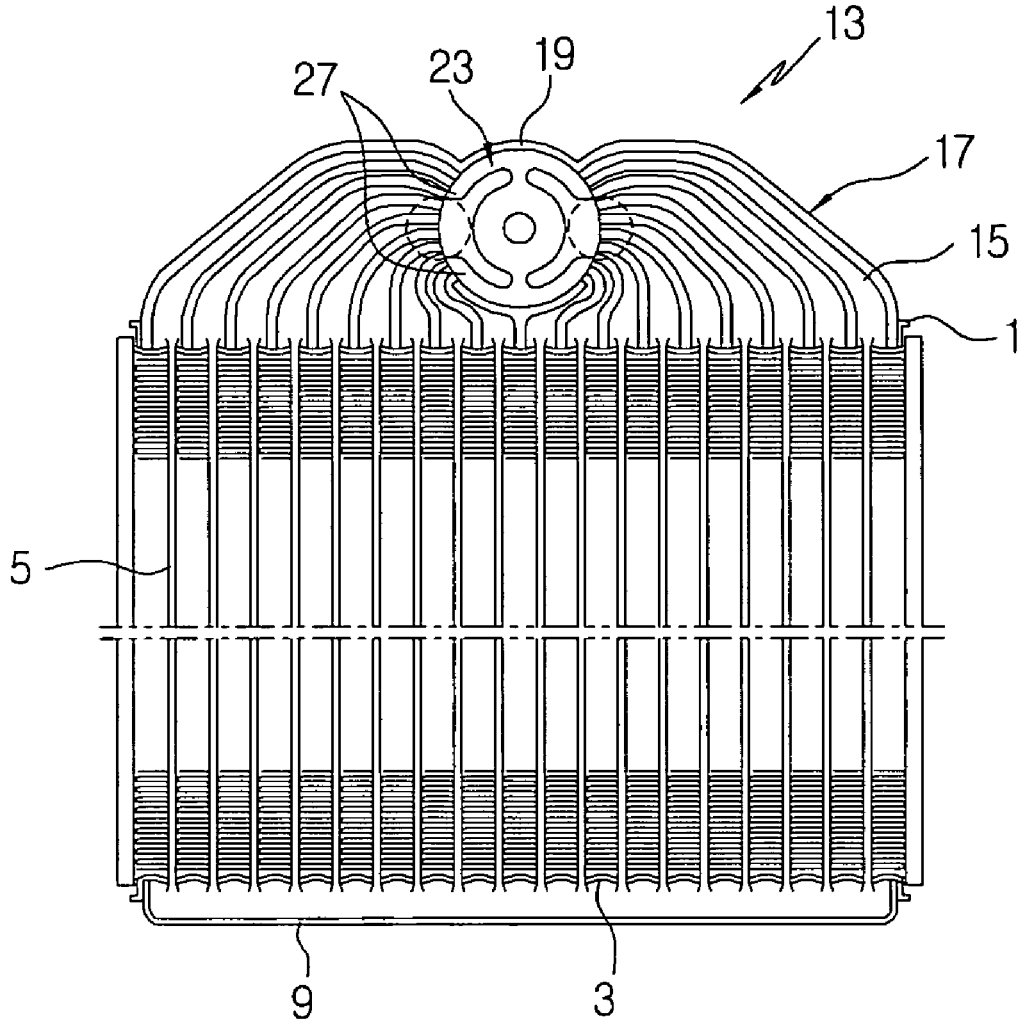
FIG. 2 is an elevational view showing a conventional heat exchanger.
Figure 3:
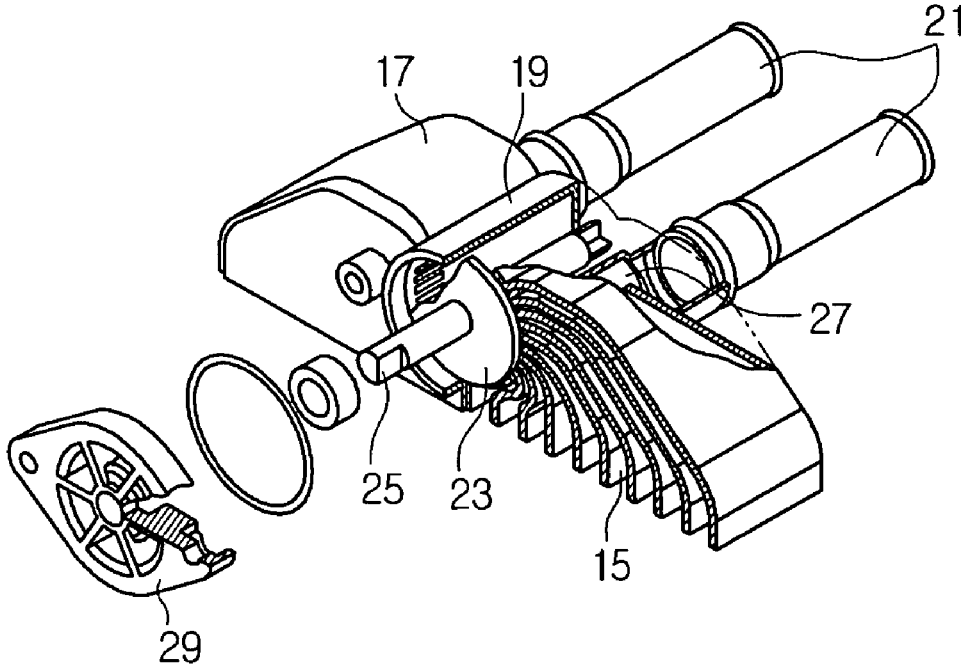
FIG. 3 is a partial perspective view showing the upper portion of the conventional heat exchanger.
Figure 4:
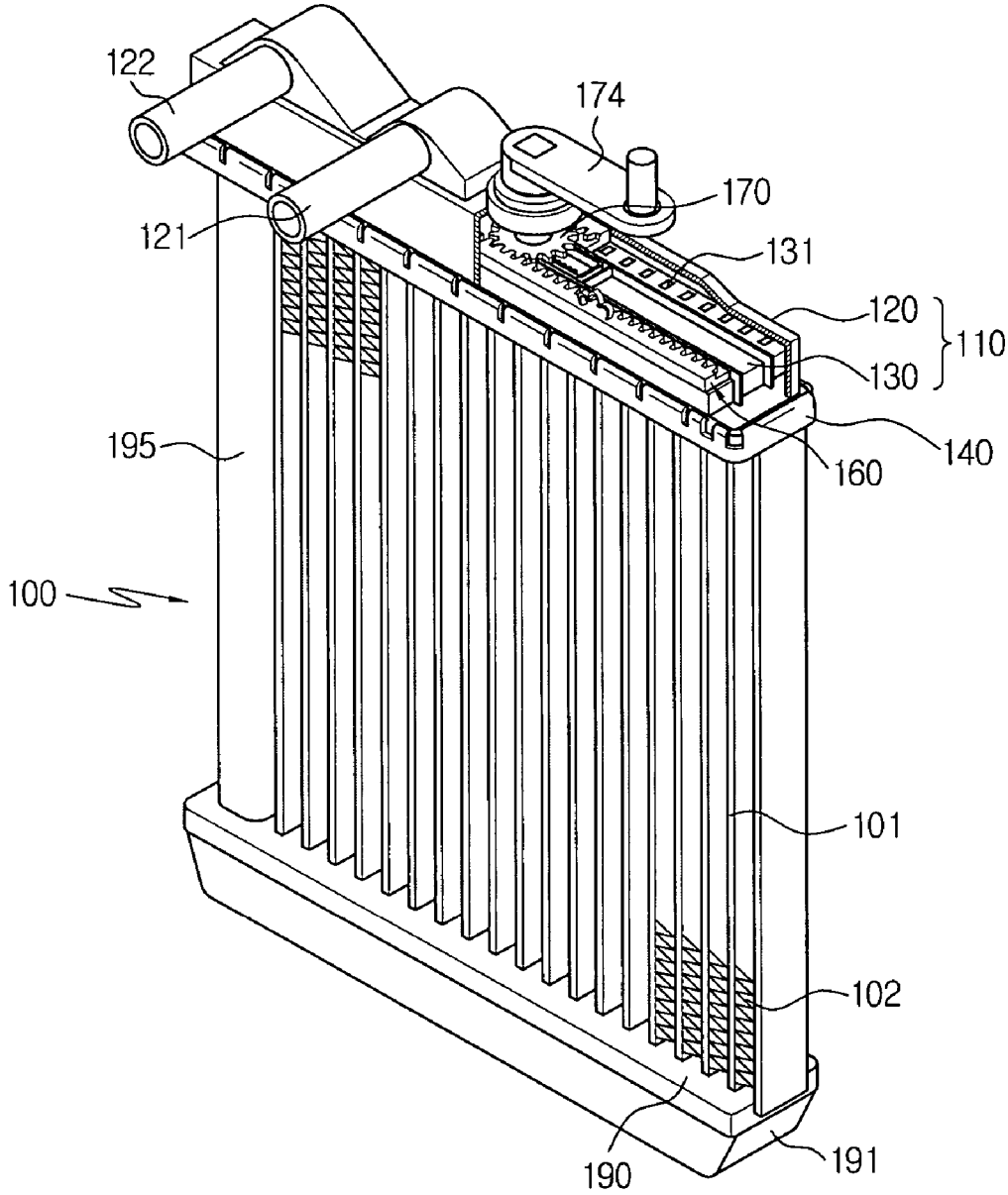
FIG. 4 is a perspective view showing a heat exchanger according to a first embodiment of the invention.
Figure 5:
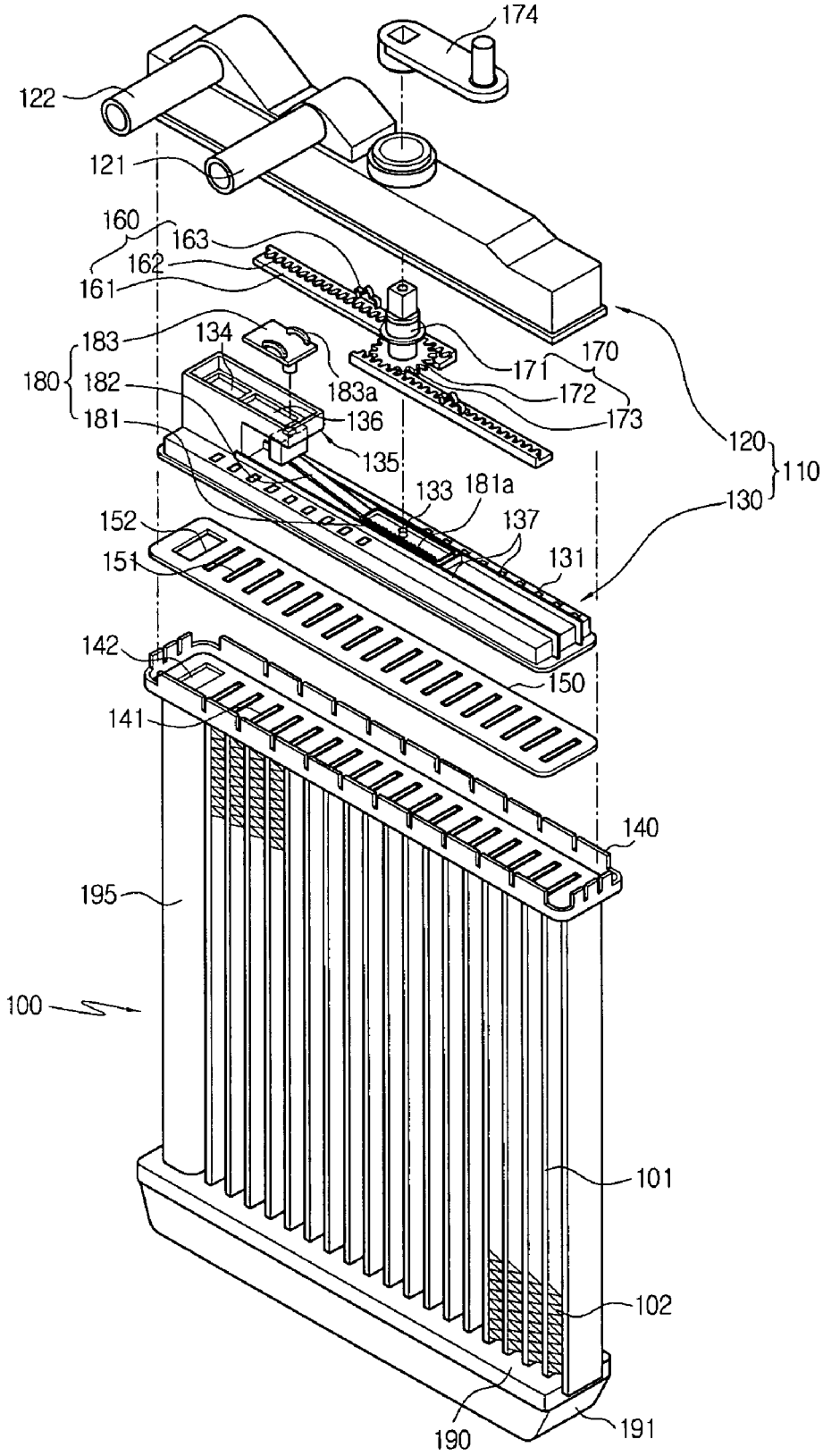
FIG. 5 is an exploded perspective view showing the heat exchanger according to the first embodiment of the invention.
Figure 6:
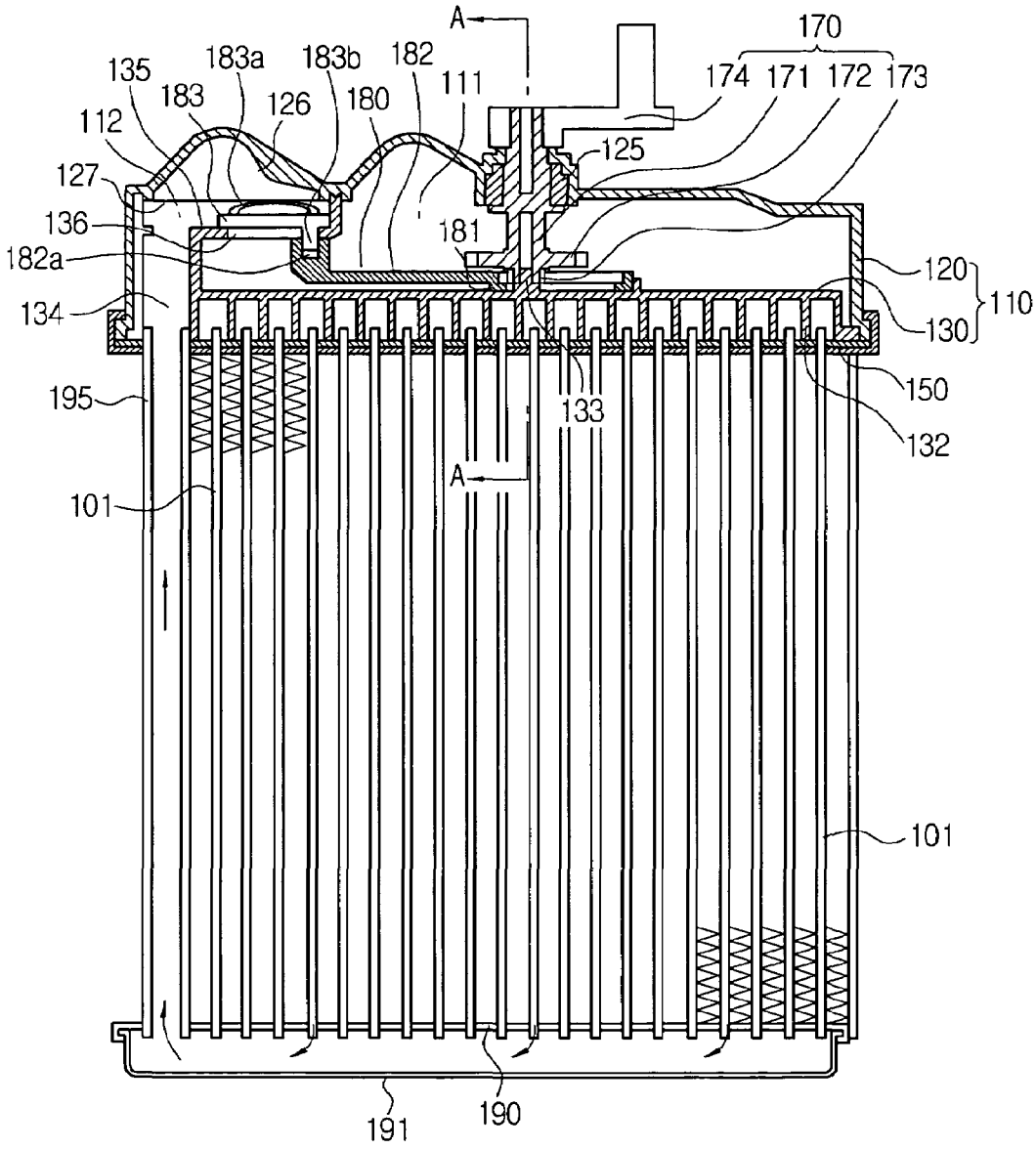
FIG. 6 is a cross-sectional view showing the heat exchanger according to the first embodiment of the invention.
Figure 7:
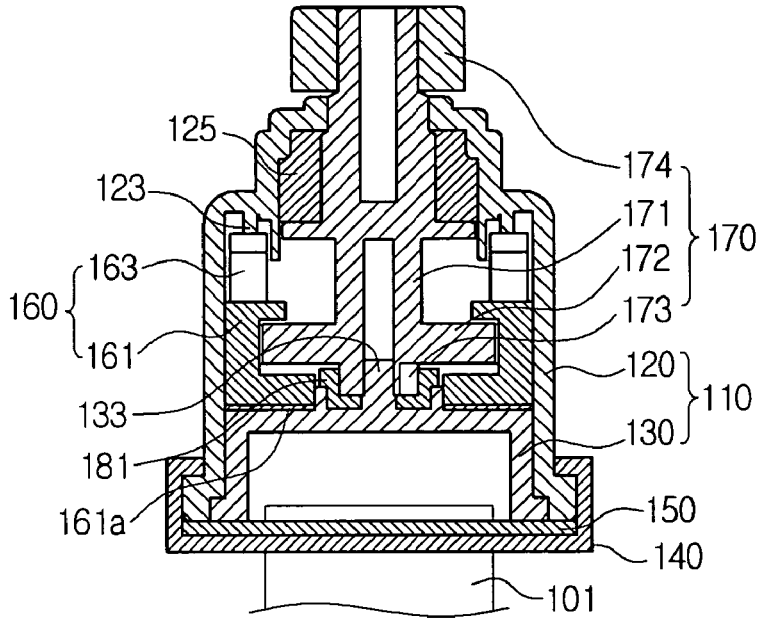
FIG. 7 is a cross-sectional view taken along the line A-A in FIG. 6.
Figure 8:
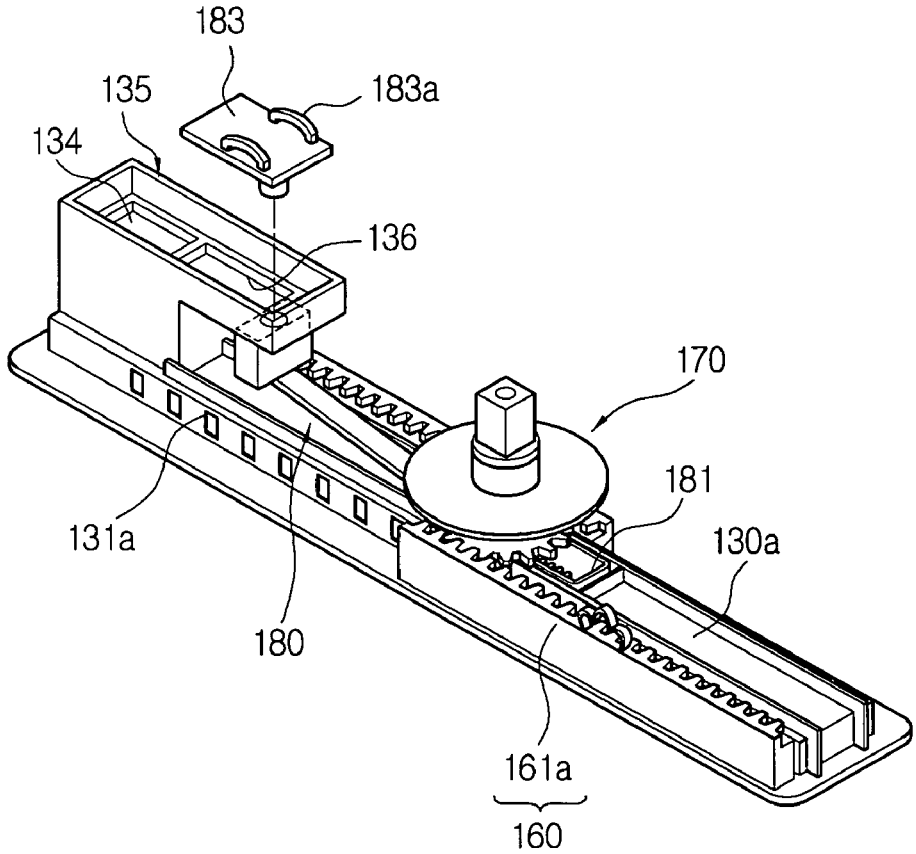
FIG. 8 is a perspective view schematically showing the case where the location of a distribution hole is changed in the heat exchanger according to the first embodiment of the invention.
Figure 9A:
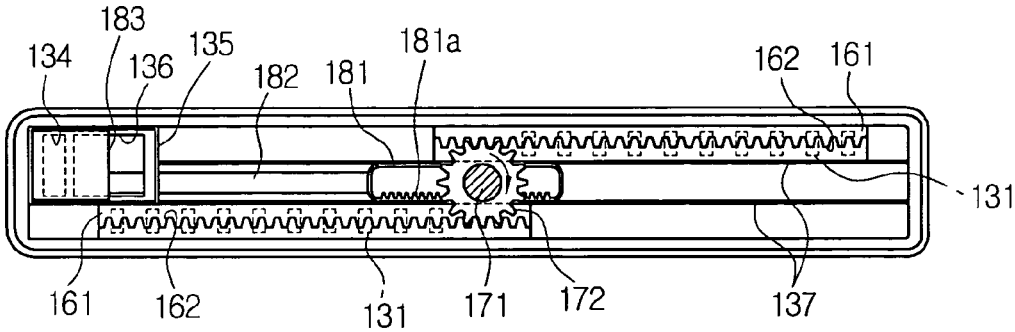
FIGS. 9*a* to 9*c* show the operating state of the heat exchanger according to the first embodiment of the invention.
Figure 9B:
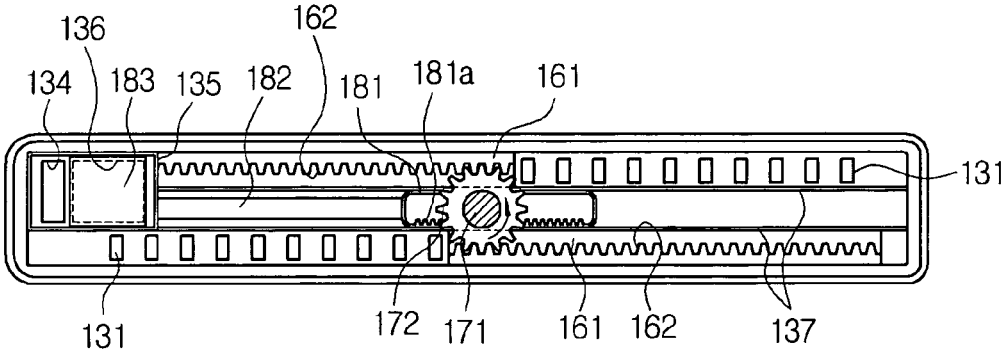
Figure 9C:
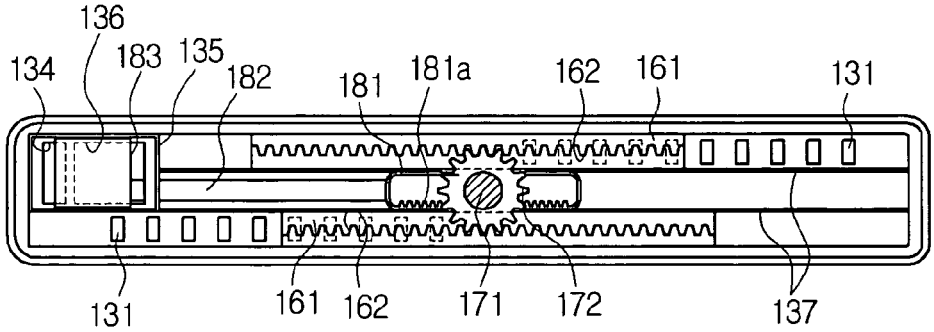

FIG. 4 is a perspective view showing a heat exchanger according to a first embodiment of the invention. FIG. 5 is an exploded perspective view showing the heat exchanger according to the first embodiment of the invention. FIG. 6 is a cross-sectional view showing the heat exchanger according to the first embodiment of the invention. FIG. 7 is a cross-sectional view taken along the line A-A in FIG. 6. FIG. 8 is a perspective view schematically showing the case where the location of a distribution hole is changed in the heat exchanger according to the first embodiment of the invention. FIGS. 9*a* to 9*c* show the operating state of the heat exchanger according to the first embodiment of the invention.

As shown in the figures, the heat exchanger 100 according to the invention comprises: a plurality of tubes 101 arranged spaced apart from one another at regular intervals in such a fashion that both ends of each tube are fixed to upper and lower headers 140 and 190, respectively, for flowing a heat exchange medium therethrough; an upper tank 110 that includes a first tank 120 coupled to the upper header 140 and formed with an inlet and outlet pipes 121 and 122 at one side thereof so that the heat exchange medium may flow in and flow out, and a second tank 130 housed in the first tank 120, the second tank being formed on a top thereof with a pair of the array of the distribution holes 131 spaced apart from each other by a certain distance and offset in the diagonal direction and formed at one side thereof with a collecting hole 134; a first opening and closing means 160 slidably installed inside the upper tank 110 for opening and closing a pair of the array of the distribution holes 131; a control means 170 rotatably installed inside the upper tank 110 for receiving an external power to operate the first opening and closing means 160, while regulating the supply amount of the heat exchange medium; and a lower tank 191 coupled to the lower header 190, the lower tank being fluid-communicated with a lower end portion of each tube 101 and fluid-communicated with the upper tank 110 so that the heat exchange medium is returned to the upper tank 110 through a return pipe 195.

On the other hand, heat radiating fins 102 for facilitating heat exchange can be interposed between the tubes 101.

First, the structure of the upper tank 110 will be explained in detail hereinafter.

The first tank 120 formed with an opened bottom is coupled to the upper header 140, and an inlet and outlet pipes 121 and 122 fluid-communicated with the inside of the first tank are formed at one side of the top of the first tank in the same direction, respectively. However, the first tank may be formed in an opposite way.

Then, the second tank 130 is housed below the opened bottom of the first tank 120, and a partitioning unit 135 is extended from the collecting hole 134 on the top of one side of the second tank so as to divide the inside of the upper tank 110 into an outlet passageway 112 and an inlet passageway 111 respectively.

That is, the outlet passageway 112 allows the collecting hole 134 to be fluid-communicated with the outlet pipe 122, and the inlet passageway 111 allows the distribution hole 131 to be fluid-communicated with the inlet pipe 121.

In addition, a bypass hole 136 for fluid-communicating the outlet passageway 112 and inlet passageway 111 with each other is formed at the partitioning unit 135. According to the opening and closing of the bypass hole 136, all the heat exchange medium flown in through the inlet pipe 121 are supplied to the tubes 101, or some of the flown-in heat exchange medium are supplied to the tubes 101, and some of the heat exchange medium can be directly bypassed to the outlet pipe 122.

Then, a second opening and closing means 180 for selectively opening and closing the collecting hole 134 and the bypass hole 136 through the operation of the control means 170 is installed inside the upper tank 110.

The second opening and closing means 180 includes a carrying member 181 that is formed at one inner side with a gear 181*a* so as to be engagingly coupled to a second gear 173 of the control means 170, and reciprocates in connection with forward and reverse rotation of the control means 170, a bypass valve 183 that is slidably rested inside the partitioning unit 135 for selectively opening and closing the collecting hole 134 and the bypass hole 136, and a connecting member 182 for connecting the carrying member 181 and the bypass valve 183 with each other.

Here, the carrying member 181 is formed of a rectangular structure having a pass-through hole formed thereinside, and is engagingly coupled to the inserted second gear 173 of the control means 170. In this case, the carrying member is preferably formed with the gear 181*a* only at one side thereof within so as to be reciprocated.

In addition, the carrying member 181 and the connecting member 182 are formed integrally with each other into one piece, and the connecting member 182 is detachably coupled to the bypass valve 183.

That is, a connection depression 182*a* is upwardly formed at the end of the connecting member 182, and a connection prominence 183*b* downwardly extending from the bypass valve 183 is inserted into this connection depression 182*a* to be engaged.

Then, a pair of elastic members 183*a* is further provided on the top of the bypass valve 183 so that the bypass valve 183 is tightly attached to the bottom surface inside the partitioning unit 135 in a sliding manner by a certain elastic force. A pressing guide 127 is predominantly formed on the inner top surface of the first tank 120 so as to evenly press the elastic member 183*a*.

Accordingly, even though the bypass valve 183 slides in order to open and close the collecting hole 134 and the bypass hole 136, it always maintains a state of being tightly attached to the bottom surface of the partitioning unit 135, thereby preventing leakage of the heat exchange medium.

Here, the elastic member 183*a* predominantly formed from the bypass valve 183 can be constructed in a wide variety of shapes, and steel material can be used for the elastic member. However, nylon is preferably used for the elastic member in order to prevent corrosion and the like.

In addition, the bottom surface of the bypass valve 183 is coated with diverse materials, such as Teflon or rubber, in order to further improve a sealing effect.

Then, a protrusion 126 for reducing the top surface cross section of the bypass hole 136 is further formed on the inner surface of the first tank 120 so that too many heat media are prevented from being abruptly bypassed through the bypass hole 136 when the bypass hole 136 is initially opened by the bypass valve 183.

The protrusion 126 is preferably formed such that the top surface cross section of the bypass hole 136 is gradually increased as the bypass hole 136 is increasingly opened by the bypass valve 183.

In this manner, according to the location of opening and closing the distribution hole 131 by the slide valve 161 described below, the opening rate of the bypass hole 136 is varied by the bypass valve 183, so that an appropriate amount of fluid can be bypassed.

Then, the first opening and closing means 160 is placed at each side of the control means 170, of which a gear 162 is formed on one side surface facing the side surface of the counterpart so as to be engagingly coupled to a first gear 172 of the control means 170. The first opening and closing means is formed with a pair of slide valves 161 that reciprocate in the opposite directions each other in connection with forward and reverse rotation of the control means 170, and open and close a pair of the distribution holes 131.

An elastic member 163 is further provided on the top surface of the slide valve 161 so that the slide valve 161 is tightly attached to the top surface of the second tank 130 in a sliding manner by a certain elastic force, and a pressing guide 123 is predominantly formed on the inner top surface of the first tank 120 so as to evenly press the elastic member 163.

Here, the bottom surface of the slide valve 163 is coated with diverse materials 161*a*, such as Teflon or rubber, in order to further improve a sealing effect.

In addition, the elastic member 163 provided on the top of the slide valve 161, which is predominantly formed on the slide valve 161, can be constructed in a wide variety of shapes, such as a streamlined shape, and steel material can be used for the elastic member. However, nylon is preferably used for the elastic member in order to prevent corrosion and the like.

Then, a pair of guides 137 for guiding the reciprocating motion of the slide valve 161 and the carrying member 181 of the second opening and closing means 180 is further formed on the top of the second tank 130.

The guides 137 forming a pair are spaced apart from each other, and facilitate the reciprocating motion of the carrying member 181 placed between the guides, and a pair of slide valves 161 placed on the outer surfaces of the guides.

In addition, partitioning walls 132 are formed between the tubes 101 on the inner surface of the second tank 130 so that each distribution holes 131 is independently fluid-communicated with each tube 101.

Accordingly, in the present invention, the number of the distribution holes 131 is the same as that of the tubes 101.

On the other hand, preferably, a rubber member 150 is further installed between the upper header 140 and the upper tank 110 in order to improve a sealing effect.

Also, tube holes 141 and 151 are formed at the upper header 140 and the rubber member 150 in order to be fluid-communicated with the tubes 101, and collecting holes 142 and 152 fluid-communicated with the return pipe 195 are formed at one sides of the rubber member and the upper header, respectively.

In addition, the rubber member 150 may be installed between the lower header 190 and the lower tank 191.

Then, the control means 170 includes a shaft 171 that is rotatably installed, the shaft having an upper end passing through the top surface of the first tank 120, and a lower end coupled to a support protrusion 133 that is prominently formed on the top of the second tank 130, a first gear 172 that is form at a certain vertical position of the shaft 171 and engagingly coupled to the gear 162 of the slide valve 161, the slide valve being the first opening and closing means 160, a second gear 173 that is formed below the first gear 172 of the shaft 171 and engagingly coupled to the gear 181*a* of the carrying means 181, the carrying means being the second opening and closing means 180, and a lever 174 that is coupled to the upper end of the shaft 171 protruded toward the outside of the first tank 120 and transfers an external power to the shaft.

In addition, a sealing member 125 is further installed between the shaft 171 and the first tank 120.

The upper end of the shaft 171 is formed in a polygonal shape so as to correctly transfer the rotation force of the lever 174.

On the other hand, the lever 174 is connected to a motor or an actuator that is not shown.

As described above, in the heat exchanger 100 according to the first embodiment of the invention, when a heat exchange medium flows into the inner inlet passageway 111 of the upper tank 110 through the inlet pipe 121, the heat exchange medium is directly bypassed to the outlet pipe 122 through the bypass hole 136 according to the opening and closing operation of the slide valve 161 and the bypass valve 183 performed by the operation of the control means 170, or returned through the return pipe 195 and discharged to the outlet pipe 122 after exchanging heat with outer air while flowing through a plurality of tubes 101 via the distribution holes 131.

Hereafter, the circulation process of the heat exchange medium will be explained in further detail hereinafter.

If the lever 174 is turned at a certain angle using a control switch (not shown) while the heat exchange medium is circulated, the first and the second gear 172 and 173 rotate together with the shaft 171, and thus the slide valve 161 and the bypass valve 183 operate in a sliding manner.

At this time, according to the locations of the slide valve 161 and the bypass valve 183, the circulation path of the heat exchange medium and the amount of the heat exchange medium that is supplied to each tube 101 are changed.

For the convenience of explanation, the cases where the slide valve 161 closes all the distribution holes 131, where the slide valve 161 opens all the distribution holes 131, and where the slide valve 161 opens some distribution holes 131 will be explained.

First, the circulation process of the heat exchange medium in a case where the slide valve 161 closes all the distribution holes 131 (refer to FIG. 9*a*) is described below.

If the slide valve 161 closes all the distribution holes 131 by operating the control means 170 using the lever 174, the bypass valve 183 completely opens the bypass hole 136, and completely closes the collecting hole 134.

Accordingly, the heat exchange medium flowing into the inner inlet passageway 111 of the upper tank 110 through the inlet pipe 121 is directly bypassed to the outlet passageway 112 through the bypass hole 136, and discharged to the outlet pipe 122.

Second, the circulation process of the heat exchange medium in a case where the slide valve 161 opens all the distribution holes 131 (refer to FIG. 9*b*) will be described below.

If the slide valve 161 opens all the distribution holes 131 by operating the control means 170 using the lever 174, the bypass valve 183 completely closes the bypass hole 136, and completely opens the collecting hole 134.

Accordingly, the heat exchange medium flowing into the inner inlet passageway 111 of the upper tank 110 through the inlet pipe 121 is supplied to all the opened distribution holes 131, actively exchanges heat with outer air while flowing through all the tubes 101 that are independently fluid-communicated with the distribution holes respectively, and flows into the lower tank 191.

The heat exchange medium flown into the lower tank 191 is returned via the return pipe 195, transferred to the outlet passageway 112 of the upper tank 110 via the opened collecting hole 134, and discharged to the outlet pipe 122.

Third, the circulation process of the heat exchange medium in a case where the slide valve 161 opens some distribution holes 131 (refer to FIG. 9*c*) will be described below.

If the slide valve 161 opens some of the distribution holes 131 by operating the control means 170 using the lever 174, the bypass valve 183 is placed between the bypass hole 136 and the collecting hole 134, opens a portion of the bypass hole 136, and also opens a portion of the collecting hole 134.

Accordingly, some of the heat exchange medium flowing into the inner inlet passageway 111 of the upper tank 110 through the inlet pipe 121 is supplied to the opened distribution hole 131, and the other heat exchange medium is directly bypassed to the outlet passageway 112 through the partially opened bypass hole 136, and discharged to the outlet pipe 122.

Next, the heat exchange medium supplied to the some opened distribution holes 131 exchanges heat with outer air while flowing through some tubes 101 fluid-communicated with the opened distribution hole 131, and flows to the lower tank 191.

The heat exchange medium flown into the lower tank 191 is returned through the return pipe 195, transferred to the outlet passageway 112 of the upper tank 110 via the partially opened collecting hole 134, and discharged to the outlet pipe 122.

That is, the more the distribution holes 131 are opened by the slide valve 161, the more the bypass valve 183 closes the bypass hole 136, and thus the amount of flow bypassed through the bypass hole 136 is decreased. Contrarily, the fewer the distribution holes 131 are opened, the less the bypass valve 183 opens the bypass hole 136, and thus the amount of flow bypassed through the bypass hole 136 is increased.

In this manner, the cross section of the fluid passageway of the bypass hole 136 is changed correspondingly to the location of the slide valve 161, and thus only an appropriate amount of flow can be bypassed.

Accordingly, in the present invention, the amount of the heat exchange medium flowing through the tubes 101 can be further minutely controlled, and the flow can be selectively controlled, so that heat exchange capability can be effectively controlled according to cooling and heating loads. The heat exchange medium is evenly distributed to the tubes 101, thereby improving heat exchange performance.

In addition, one distribution hole 131 is constructed for one tube 101, so that temperature can be minutely controlled with small temperature deviation in each step, and the opening and closing method of the distribution hole 131 is configured in a sliding type that uses a slide valve 161, so that the shapes of the header 140 and the tank 110 are simplified, and a clamping operation is improved at the same time.

On the other hand, in the above descriptions, a pair of the array of the distribution holes 131 is formed on the top of the second tank 130. However, as shown in FIG. 8, a pair of the array of the distribution holes 131*a* may be formed at both sides of the second tank 130*a*.

At this point, a pair of slide valves 161*a* is, of course, placed at both sides of the second tank 130*a*.

Figure 10:
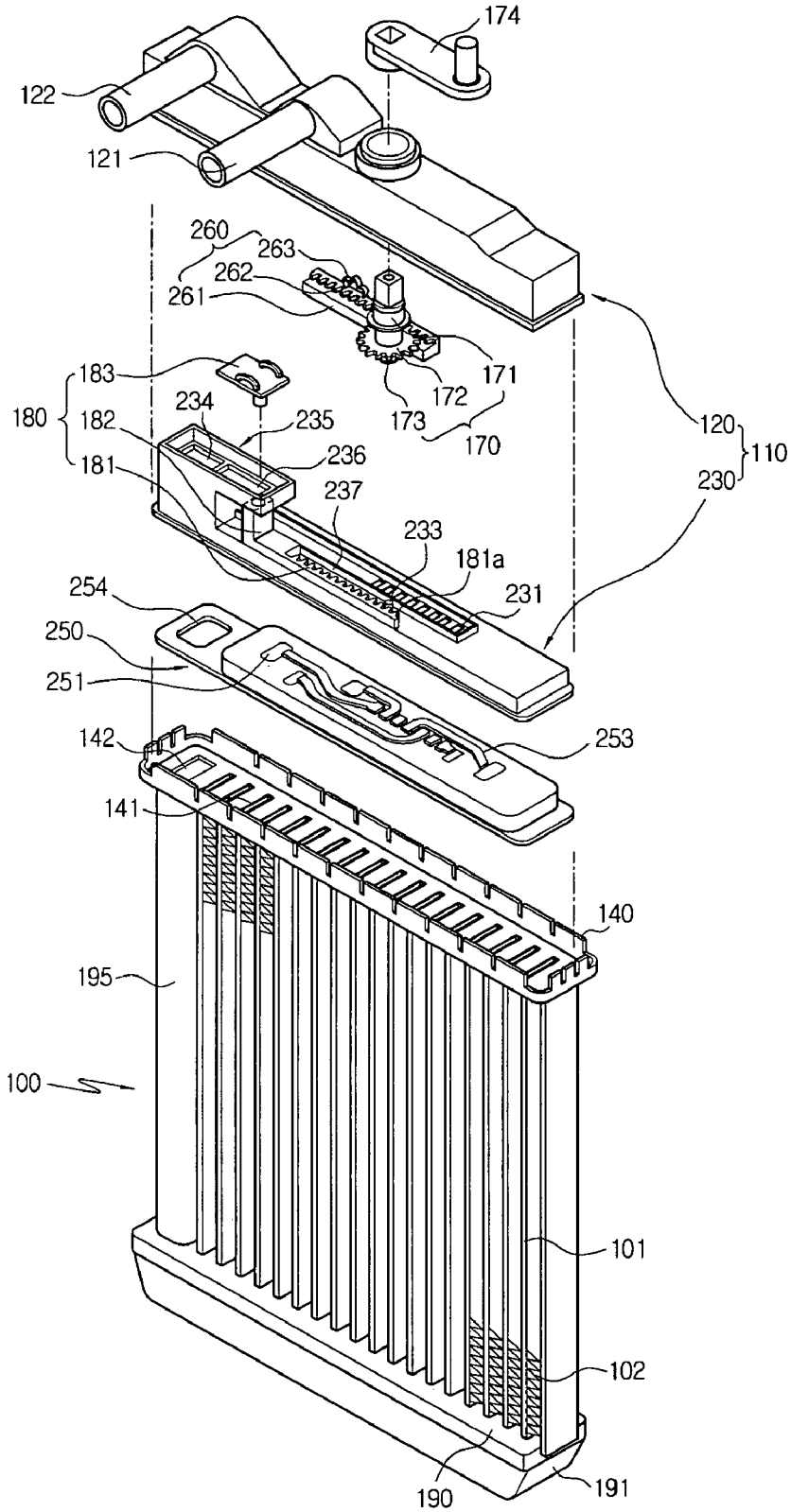
FIG. 10 an exploded perspective view showing a heat exchanger according to a second embodiment of the invention.
Figure 11:
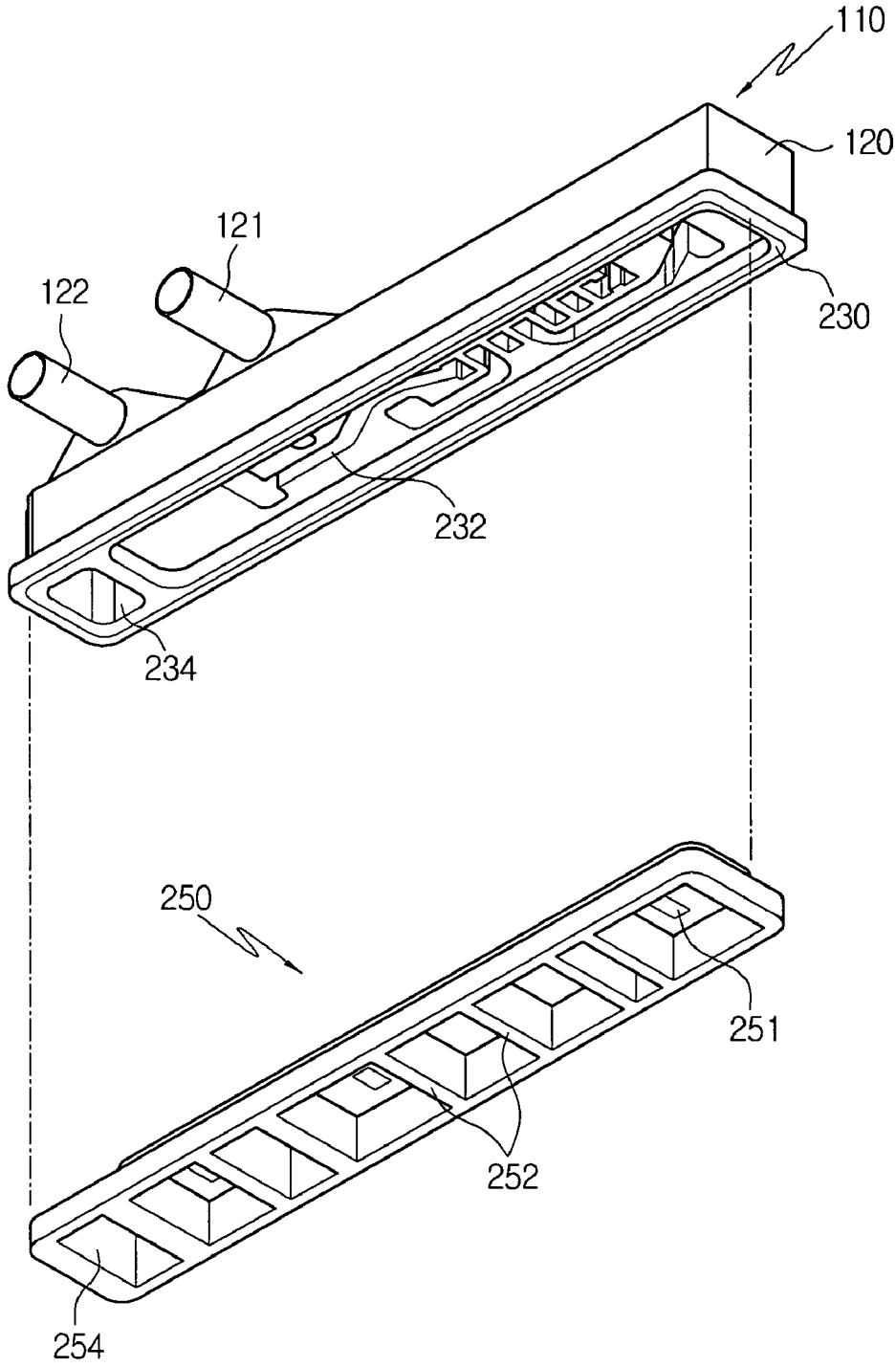
FIG. 11 is a bottom side perspective view showing a disassembled upper tank and distribution means in the heat exchanger according to the second embodiment of the invention.
Figure 12:
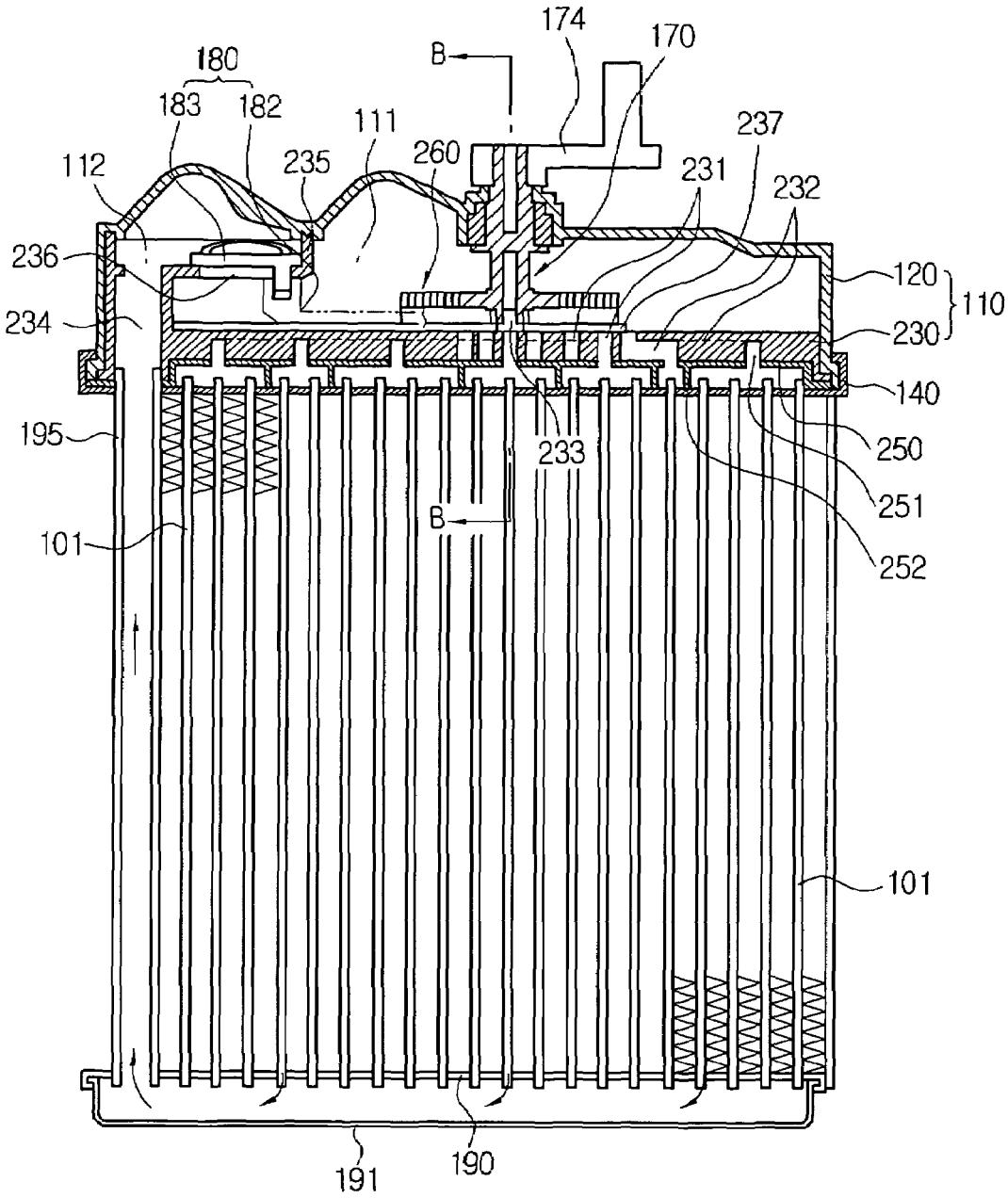
FIG. 12 is a cross-sectional view showing the heat exchanger according to the second embodiment of the invention.
Figure 13:
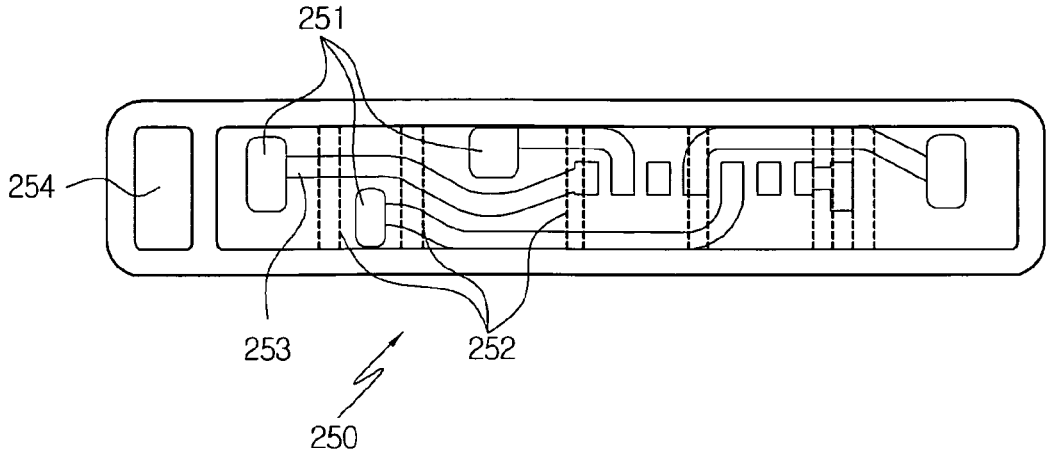
FIG. 13 a plan view showing the distribution means in the heat exchanger according to the second embodiment of the invention.
Figure 14:
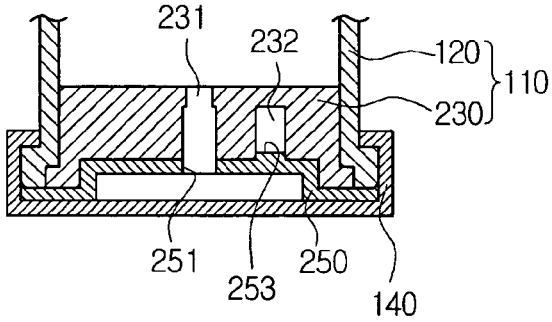
FIG. 14 is a cross-sectional view taken along the line B-B in FIG. 7.

FIG. 10 is an exploded perspective view showing a heat exchanger according to a second embodiment of the invention. FIG. 11 is a bottom side perspective view showing a disassembled upper tank and distribution means in the heat exchanger according to the second embodiment of the invention. FIG. 12 is a cross-sectional view showing the heat exchanger according to the second embodiment of the invention. FIG. 13 is a plan view showing the distribution means in the heat exchanger according to the second embodiment of the invention. FIG. 14 is a cross-sectional view taken along the line B-B in FIG. 7. Only the configurations and operations different from those of the first embodiment will be explained in order to avoid repetition of explanations.

As shown in drawings, in the second embodiment, the distribution holes 231 formed at a second tank 230 is fewer than the tubes 101 in number.

The heat exchanger 100 comprises: a plurality of tubes 101 arranged spaced apart from one another at regular intervals in such a fashion that both ends of each tube are fixed to upper and lower headers 140 and 190, respectively, for flowing a heat exchange medium therethrough; an upper tank 110 that includes a first tank 120 coupled to the upper header 140 and formed with an inlet and outlet pipes 121 and 122 at one side thereof so that the heat exchange medium may flow in and flow out, and a second tank 130 housed in the first tank 120, the second tank having a plurality of distribution holes 231 formed on a top thereof in a row at regular intervals, a collecting hole 234 formed at one side thereof and a distribution passage 232 for distributing the heat exchange medium flown into the distribution holes 231 to specific tubes 101 formed thereinside; a distribution means 250 installed between the upper header 140 and the upper tank 110 for supplying the heat exchange medium distributed through the distribution passage 232 to specific tubes 101 in a partitioned manner; a first opening and closing means 260 slidably installed inside the upper tank 110 for opening and closing the distribution holes 231; a control means 170 rotatably installed inside the upper tank 110 for receiving an external power to operate the first opening and closing means 260 while regulating the supply amount of the heat exchange medium; and a lower tank 191 coupled to the lower header 190, the lower tank being fluid-communicated with a lower end portion of each tube 101 and fluid-communicated with the upper tank 110 so that the heat exchange medium is returned to the upper tank 110 through a return pipe 195.

First, the distribution means 250 has a plurality of supplying holes 251, each of which is fluid-communicated with the tubes 101 that are grouped in a certain number, a guide 253 formed on the top surface for firmly covering the opened bottom of each distribution passage 232 and guiding the heat exchange medium flowing through the distribution passage 232 to each supply hole 251, and a collecting hole 254 formed at one side thereof so as to be fluid-communicated with the return pipe 195.

Here, the distribution means 250 is formed of a rubber material or a synthetic resin material, and installed between the upper tank 110 and the upper header 140 of the heat exchanger 100 in order to minimize the heat transfer to the tubes 101 when the heat exchange medium is bypassed.

Then, partitioning walls 252 are formed between the supply holes 251 inside the distribution means 250 so that each distribution passage 232 of the second tank 230 is independently fluid-communicated with the tubes 101 grouped in a certain number.

The partitioning wall 252 allows the heat exchange medium supplied through the supply hole 251 to be supplied to a certain number of corresponding tubes 101 partitioned by the partitioning wall 252.

On the other hand, if the location and the shape of the distribution passage 232 of the second tank 230 are changed, together with the guide 253 and the partitioning wall 252 of the distribution means 250, since the number and shapes of the fluid-passageways for the heat exchange medium flowing into the partitioned specific tubes 101 can be further diversely changed, i.e. arbitrarily controlled, the rate of temperature variation (slope) is maintained and controlled constantly, so that the accuracy of temperature control can be improved, and temperature can be minutely controlled.

Then, the distribution passage 232 is formed at an appropriate interval so as to correspond to the guide 253 and the supply hole 251. The front end of the distribution passage is fluid-communicated with the distribution hole 231, and the rear end of the distribution passage is extended to the supply hole 251, so that the distribution passage is fluid-communicated with the supply hole 251.

Such a distribution passage 232 forms a firmly covered fluid-passageway when coupled to the guide 253, so that the heat exchange medium supplied through the distribution holes 231 can be stably flown into each supply hole 251 of the distribution means 250.

Then, all the distribution holes 231 can be formed in the same size. However, the size of the distribution holes 231 is preferably formed in proportion to the number of the corresponding tubes 101 fluid-communicated with the distribution hole 231.

That is, the size of the distribution hole 231 is determined such that the more the number of the corresponding tubes 101 are, the larger the size of the distribution hole is, and vice-versa. Therefore, the heat exchange medium flowing in through an inlet pipe 121 and passing through each distribution hole 231 is supplied in proportion to the number of the corresponding tubes 101. Accordingly, the heat exchange medium is evenly distributed to each tube 101, and the amount and the flow rate of the heat exchange medium flowing through the tubes 101 are maintained uniformly, thereby balancing the difference between the temperature of the left and the right sides of the heat exchanger, and improving the heat exchange performance Then, the first opening and closing means 260 is placed at one side of the control means 170, and is formed at one side thereof with a gear 262 so as to be engagingly coupled to a first gear 172 of the control means 170, and formed with a slide valve 261 that reciprocates in connection with forward and reverse rotation of the control means 170, and opens and closes a plurality of the distribution holes 231 formed in a row.

An elastic member 263 is further provided on the top of the slide valve 261 so that the slide valve 261 is tightly attached to the top surface of the second tank 230 in a sliding manner by a certain elastic force, and a pressing guide 123 is predominantly formed on the inner top surface of the first tank 120 so as to evenly press the elastic member 263.

Here, the bottom surface of the slide valve 261 is coated with diverse materials, such as Teflon or rubber, in order to further improve a sealing effect.

In addition, the elastic member 263 provided on the top of the slide valve 261, which is predominantly formed on the slide valve 261, can be constructed in a wide variety of shapes, such as a streamlined shape, and nylon material is preferably used for elastic member in order to prevent corrosion and the like Then, a guide 237 for guiding the reciprocating motion of the slide valve 261 and a carrying member 181 of a second opening and closing means 180 is further formed on the top of the second tank 230.

In addition, as shown in the first embodiment, a partitioning unit 235 extends from the collecting hole 234 formed don the top of one side of the second tank 230 so as to divide the inside of the upper tank 110 into an outlet passageway 112 and an inlet passageway 111, respectively.

A bypass hole 236 for fluid-communicating the outlet passageway 111 and the inlet passageway 112 with each other is formed at the partitioning unit 235, and the second opening and closing means 180 for selectively opening and closing the collecting hole 234 and the bypass hole 236 through the operation of the control means 170 is installed inside the upper tank 110

The second opening and closing means 180 includes a carrying member 181 that is formed at one side thereof with a gear 181*a* so as to be engagingly coupled to a second gear 173 of the control means 170 and reciprocates in connection with forward and reverse rotation of the control means 170, a bypass valve 183 that is slidably rested within the partitioning unit 235 and selectively opens and closes the collecting hole 234 and the bypass hole 236, and a connecting member 182 for connecting the carrying member 181 and the bypass valve 183 to each other.

That is, the second gear 173 is inserted into and engagingly coupled to the inside of the carrying member 181 in the first embodiment. However, the carrying member 181 is engagingly coupled to the second gear 173 at the opposite side of the slide valve 261 in the second embodiment.

On the other hand, the control means 170 is constructed in the same structure as that of the first embodiment, i.e., is installed inside the upper tank 110 in such a fashion that an upper end of the control means passes through the top of the first tank 120, and a lower end thereof is rotatably coupled to a support protrusion 233 prominently formed on the top of the second tank 230.

Here, preferably, the support protrusion 233 is eccentrically formed at one side of the second tank as the distribution holes 231 are formed in a row at the center of the second tank 230.

In the second embodiment described above, all the structures other than the ones explained above are the same as those of the first embodiment, so that repeated explanations will be omitted here.

As described above, in the heat exchanger 100 according to the second embodiment of the invention, when a heat exchange medium flows into the inner inlet passageway 111 of the upper tank 110 through the inlet pipe 121, the heat exchange medium is directly bypassed to the outlet pipe 122 through the bypass hole 236 according to the opening and closing operation of the slide valve 261 and the bypass valve 183 performed by the control means 170, or returned through the return pipe 195 and discharged to the outlet pipe 122 after exchanging heat with outer air while flowing through a plurality of tubes 101 grouped in a certain number via the distribution holes 231 and the distribution passage 232.

Therefore, the circulation process of the heat exchange medium is the same as that of the first embodiment. One thing, one distribution hole 231 is fluid-communicated with a certain number of tubes 101, so that the heat exchange medium flown into the distribution hole 231 is supplied to the supply holes 251 of the distribution means 250 through each distribution passage 232. The heat exchange medium supplied to the supply holes 251 flows through a certain number of fluid-communicated tubes 101, and actively exchanges heat with outer air.

As described above, only a case, in which the tubes 101 are arranged in a row, and the flow of the heat exchange medium flowing through the tubes 101 is a one-pass type, is explained in the present invention. However, the present invention is not limited to this, but the flow of the heat exchange medium may be configured in a U-turn type.

That is, the tubes 101 can be arranged in a front and a rear row to form multiple rows so that the lower portions of the tubes are fluid-communicated with one another, or the tubes 101 can be arranged in a single row in such a fashion that U-shape fluid-passageways are formed inside the tubes 101, to thereby make the flow of the heat exchange medium configured in a U-turn type. In this case, preferably, the return pipe 195 is of course removed, and a fluid-passageway (not shown) separated from the distribution hole 131 is formed inside the second tank 130 so that the heat exchange medium U-turned along the tubes 101 can be discharged through the collecting hole 134.

In this way, the present invention can be applied regardless of whether the tubes 101 are arranged in either a single row or a plurality of rows, or whether the tubes are a one-pass type or a U-turn type.

As described above, according to the present invention, the flow of the heat exchange medium flowing through the tubes can be selectively controlled, and opened and closed, so that heat exchange capability can be conveniently controlled according to cooling and heating loads, and the heat exchange medium is evenly distributed and circulated through specific tubes or all the tubes without flow resistance, thereby improving mixing capability and total heat exchange performance.

In addition, one distribution hole is constructed for one tube, so that temperature can be minutely controlled with small temperature deviation in each step.

Also, the opening and closing method of the distribution hole is configured in a sliding type by a rectilinear and reciprocating motion of the slide valve, so that the shapes of the header and the tank are simplified, and a clamping operation is improved.

In addition, the heat exchange medium distribution holes that are fluid-communicated with the tubes grouped in a certain number are formed in a size that is proportional to the number of corresponding tubes, so that the amount and the flow rate of the heat exchange medium flowing through the tubes are uniformly maintained, thereby balancing the difference between the left and the right temperature, and improving the heat exchange performance.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heat exchanger comprising:

a plurality of tubes arranged spaced apart from one another at regular intervals in such a fashion that both ends of each tube are fixed to upper and lower headers, respectively, for flowing a heat exchange medium therethrough;

an upper tank including a first tank coupled to the upper header and a second tank housed in the first tank, the first tank having inlet and outlet pipes formed at one side thereof, the second tank having an array of distribution holes formed on a top thereof and a collecting hole formed at one side thereof;

a first opening and closing means slidably installed inside the upper tank for opening and closing the array of the distribution holes;

a control means rotatably installed inside the upper tank for receiving an external power to operate the first opening and closing means; and a lower tank coupled to the lower header, the lower tank being fluid-communicated with a lower end portion of each tube and fluid-communicated with the upper tank through a return pipe.

2. The heat exchanger according to claim 1, wherein a pair of the array of the distribution holes is arranged spaced apart from one another by a certain distance and offset from each other.

3. The heat exchanger according to claim 1, wherein a partitioning unit is extended at one side of the second tank so as to divide an inside of the upper tank into an outlet passageway for fluid-communicating the collecting hole and the outlet pipe with each other, and an inlet passageway for fluid-communicating the distribution hole and the inlet pipe with each other, respectively, and a bypass hole for fluid-communicating the outlet passageway and inlet passageway with each other is formed at the partitioning unit.

4. The heat exchanger according to claim 3, wherein a second opening and closing means for selectively opening and closing the collecting hole and the bypass hole through an operation of the control means is installed inside the upper tank.

5. The heat exchanger according to claim 4, wherein the second opening and closing means includes a carrying member that is formed at one side thereof with a gear so as to be engagingly coupled to the control means and reciprocates in connection with forward and reverse rotation of the control means, a bypass valve that is slidably rested inside the partitioning unit for opening and closing the collecting hole and the bypass hole, and a connecting member for connecting the carrying member and the bypass valve to each other.

6. The heat exchanger according to claim 5, wherein a elastic member is further provided on a top of the bypass valve so that the bypass valve is tightly attached to a bottom surface of the partitioning unit by certain an elastic force, and a pressing guide is further formed on an inner surface of the first tank so as to evenly press the elastic member.

7. The heat exchanger according to claim 5, wherein a protrusion for reducing a top surface cross section of the bypass hole is further formed on an inner surface of the first tank so that too many heat exchange medium are prevented from being bypassed when the bypass hole is initially opened.

8. The heat exchanger according to claim 7, wherein the protrusion is formed such that the top surface cross section of the bypass hole is gradually increased as the bypass hole is increasingly opened by the bypass valve.

9. The heat exchanger according to claim 2, wherein the first opening and closing means is placed at each side of the control means, and includes a gear formed on one side surface respectively so as to be engagingly coupled to the control means, and a pair of slide valves that reciprocate in opposite directions each other in connection with forward and reverse rotation of the control means, and open and close a pair of the array of the distribution holes.

10. The heat exchanger according to claim 9, wherein an elastic member is further provided on a top of the slide valve so that the slide valve is tightly attached to a top surface of the second tank by a certain elastic force, and a pressing guide is further formed on an inner surface of the first tank so as to evenly press the elastic member.

11. The heat exchanger according to claim 9, wherein a guide for guiding reciprocating motion of the slide valve is further formed on a top of the second tank.

12. The heat exchanger according to claim 2, wherein partitioning walls are formed between the tubes on an inner surface of the second tank so that each distribution holes is independently fluid-communicated with each tube.

13. The heat exchanger according to claim 12, wherein the number of the distribution holes is the same as that of the tubes.

14. The heat exchanger according to claim 1, wherein a rubber member is further installed between the upper header and the upper tank in order to improve a sealing effect.

15. The heat exchanger according to claim 1, wherein the control means includes a shaft that is rotatably installed, the shaft having an upper end passing through a top surface of the first tank and a lower end coupled to a support protrusion that is protrudently formed on a top of the second tank, a first gear that is form at a certain vertical position of the shaft for operating the first opening and closing means, a second gear that is formed below the first gear of the shaft for operating a second opening and closing means, and a lever that is coupled to an upper end of the shaft and transfers external power to the shaft.

16. The heat exchanger according to claim 15, wherein a sealing member is further installed between the shaft and the first tank.

17. The heat exchanger according to claim 1, wherein a distribution passage is formed inside of the second tank for distributing a heat exchange medium flown into the distribution holes to specific tubes and a distribution means is installed between the upper header and the upper tank for supplying the heat exchange medium distributed through the distribution passage to each of specific tubes separately.

18. The heat exchanger according to claim 17, wherein the first opening and closing means is placed at one side of the control means, and includes a gear formed at one side thereof so as to be engagingly coupled to the control means, and a slide valve that reciprocates in connection with forward and reverse rotation of the control means, and opens and closes the array of the distribution holes.

19. The heat exchanger according to claim 17, wherein the distribution means includes a plurality of supplying holes formed on a top thereof, each of the supplying hole being fluid-communicated with the tubes that are grouped in a certain number, a guide mounted on a top surface for covering an opened bottom of each distribution passage and guiding the heat exchange medium flowing through the distribution passage to each supply hole, and a collecting hole formed at one side thereof so as to be fluid-communicated with the return pipe.

20. The heat exchanger according to claim 19, wherein the distribution means is formed of a rubber material.

21. The heat exchanger according to claim 19, wherein partitioning walls are further formed between the supply holes inside the distribution means so that each distribution passage of the second tank is independently fluid-communicated with the tubes grouped in a certain number.

22. The heat exchanger according to claim 19, wherein the supply hole is formed in such a size that is proportional to the number of the corresponding fluid-communicated tubes.

* * * * *